US007125109B2

(12) United States Patent
Watanabe et al.

(10) Patent No.: US 7,125,109 B2
(45) Date of Patent: Oct. 24, 2006

(54) INK CONTAINER AND INK CONTAINER HOLDER

(75) Inventors: Kenjiro Watanabe, Tokyo (JP); Masanori Takenouchi, Kanagawa-ken (JP); Yasuo Kotaki, Kanagawa-ken (JP); Wataru Takahashi, Kanagawa-ken (JP); Masashi Ogawa, Kanagawa-ken (JP); Hiromasa Anma, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 10/884,951

(22) Filed: Jul. 7, 2004

(65) Prior Publication Data

US 2005/0036016 A1 Feb. 17, 2005

(30) Foreign Application Priority Data

Jul. 7, 2003 (JP) ..... 2003-271426

(51) Int. Cl.
*B41J 2/175* (2006.01)
*B41J 29/393* (2006.01)
*B41J 2/14* (2006.01)

(52) U.S. Cl. ..... 347/86; 347/19; 347/50

(58) Field of Classification Search ..... 347/7, 347/19, 50, 58, 85, 86
See application file for complete search history.

(56) References Cited

U.S. PATENT DOCUMENTS

| | | | | |
|---|---|---|---|---|
| 5,583,549 | A | 12/1996 | Ujita et al. | 347/86 |
| 5,610,635 | A * | 3/1997 | Murray et al. | 347/7 |
| 5,619,237 | A | 4/1997 | Inoue et al. | 347/86 |
| 5,699,091 | A | 12/1997 | Bullock et al. | |
| 5,748,210 | A | 5/1998 | Watanabe et al. | |
| 5,751,320 | A | 5/1998 | Scheffelin et al. | |
| 5,988,804 | A | 11/1999 | Kotaki et al. | 347/87 |
| 6,145,975 | A | 11/2000 | Kotaki et al. | |
| 6,168,262 | B1 * | 1/2001 | Clark et al. | 347/50 |
| 6,227,643 | B1 * | 5/2001 | Purcell et al. | 347/19 |
| 6,247,598 | B1 | 6/2001 | Hosaka et al. | 206/723 |
| 6,302,535 | B1 | 10/2001 | Sturgeon et al. | |
| 6,312,084 | B1 | 11/2001 | Ujita et al. | |
| 6,502,917 | B1 * | 1/2003 | Shinada et al. | 347/19 |
| 6,623,104 | B1 | 9/2003 | Kotaki et al. | 347/49 |
| 6,631,978 | B1 | 10/2003 | Watanabe et al. | 347/49 |
| 2001/0026301 | A1 | 10/2001 | Fukazawa et al. | |
| 2002/0024559 | A1 | 2/2002 | Murray et al. | |
| 2004/0246304 | A1 | 12/2004 | Takahashi et al. | 347/49 |
| 2004/0246317 | A1 | 12/2004 | Hayashi et al. | 347/86 |

FOREIGN PATENT DOCUMENTS

| | | |
|---|---|---|
| CN | 1312166 | 9/2001 |
| EP | 878307 | 11/1998 |
| EP | 997297 | 5/2000 |
| EP | 1232871 | 8/2002 |
| JP | 8-318621 | 12/1996 |
| JP | 10-323995 | 12/1998 |

(Continued)

*Primary Examiner*—Anh T. N. Vo
(74) *Attorney, Agent, or Firm*—Fitzpatrick, Cella, Harper & Scinto

(57) ABSTRACT

An ink container for supplying through an ink supply port ink accommodated in a main body of the container, the ink container including a substrate mounted on a surface of the main body of the container, and a contact portion and a storing element electrically connected with contact the portion, the contact portion and the storing element being provided on the substrate, Characterized In That the contact portion is disposed at a position more remote from the ink supply port than the storing element.

6 Claims, 15 Drawing Sheets

FOREIGN PATENT DOCUMENTS

| | | |
|---|---|---|
| JP | 2002-46290 | 2/2002 |
| JP | 2002-120379 | 4/2002 |

* cited by examiner (a)

(b)

INK CONTAINER AND INK CONTAINER HOLDER

FIELD OF THE INVENTION AND RELATED ART

The present invention relates to an ink container and an ink container holder.

As for an ink container, there is such an ink container as the one disclosed in U.S. Pat. No. 6,145,975 that is mounted into the main assembly of an apparatus through a rotational movement. An ink container of this type is preferable as an ink container for a recording apparatus, in particular, a recording apparatus of a space saver type. It is mounted into the main assembly of a recording apparatus as shown in FIGS. 10(*a*)–10(*d*). That is, the ink container 100 storing ink in its actual container portion (which hereinafter will be referred to as container proper) is mounted into the ink container holder 120 having the recording head 110, through a rotational motion. Then, the holder 120 is mounted onto the carriage of a recording apparatus of a serial scan type. The ink within the ink container 100 is supplied to the recording head 110 through the ink outlet 100A located at the bottom of the ink container, and the built-in ink tube 121 of the holder 120. The top end of the ink tube 121 is fitted with a filter.

The procedure for mounting the ink container 100 is as follows. First, the ink container 100 is inserted downward into the holder 120, at an angle, through the opening of the holder 120, as shown in FIG. 10(*a*), so that the front surface of the ink container 100 remains in contact with the rib 120A of the holder 120, and also, that the rounded corner 100B of the ink container 100 remains in contact with the internal surface of the side wall of the holder 120. As a result, the ink container 100 is rotationally moved downward as indicated by an arrow mark as shown in FIG. 10(*b*). During this movement of the ink container 100, the rounded front corner 100C of the ink container 100 comes into contact with the internal surface of the holder 120, and the ink tube 121 of the holder 120 enters the ink outlet 10A. More specifically, the ink container 100 rotates about the contact area between its front wall and the rib 120A of the holder 120, with the bottom front portion of the ink container 100 moving frontward (rightward in drawing), until the top wall 100D of the ink container 100 comes into contact with the overhang 122 of the holder 120 as shown in FIG. 10(*c*). The bottom portion of the overhang 122 has a curved portion 122A and a flat horizontal portion 122B. After the contact is made between the top wall 100B of the ink container 100 with the curved portion 122A of the overhang 122 of the holder 120, as shown in FIG. 10(*c*), the ink container 100 further rotates until its top wall 100D comes into contact with the flat horizontal portion 122B of the overhang 122 of the holder 1 as shown in FIG. 10(*d*). When the ink container 100 is in the position shown in FIG. 10(*d*), the ink container 100 is firmly held in the holder 120 by the reactive force which the elastic plate 123 located at the bottom of the internal space of the holder 120 generates as the elastic plate 123 is pressed downward by the bottom of the ink container 100 after the contact is made between the elastic plate 123 and the bottom of the ink container 100 shown in FIG. 10(*a*). In other words, it requires only a very small space to firmly hold the ink container 100.

U.S. Pat. No. 6,302,535 discloses an ink container equipped with a storage element. This ink container also is mounted into a holder through a rotational motion, although the method by which it is rotated is different from the method by which the ink container disclosed in U.S. Pat. No. 6,145,975 is rotated. As this ink container is mounted into the holder, the electrical contacts on the ink container side come into contact with the electrical contacts on the holder side, establishing thereby electrical connection between the storage element on the ink container side and the counterpart on the recording apparatus side. The storage element is capable of storing various data, for example, data regarding the amount of the ink remainder in the ink container to which the storage element belongs, data specific to the ink container to which the storage element belongs, etc. Ink containers having a storage element are disclosed also in Japanese Laid-open Patent Application 10-323995 and U.S. Published Patent Application No. AA2001,026,301.

In the case of a rotational insertion type ink container equipped with a storage element, the locations of the electrical contacts on the ink container side have the following effect upon the contact pressure between the electrical contacts on the ink container side and the electrical contacts on the holder side.

FIGS. 11(*a*) and 11(*b*) are schematic views of a hypothetical ink container 100 which is equipped with a storage element, and which is mounted into a recording apparatus through a rotational motion about the rotational center O. The ink container in FIG. 11(*a*) and the ink container in FIG. 11(*b*) are different in the location of the electrical contact 110. The rotational center O is the point (line) about which the ink container 100 rotates when the ink container 100 is mounted or dismounted. The rotational center O is located near the bottom wall of the ink container 100, which has the ink outlet 100A. In order to assure that electrical connection is established between the storage element of the ink container 100 and the counterpart of the holder, it is desired that as the ink container 100 is mounted into the holder, a large amount of contact pressure is generated, and maintained, between the electrical contact 101 on the ink container side and the electrical contact on the holder side. In the case of the ink container 100 in FIG. 11(*a*), its electrical contact 101 is placed close to the bottom of the ink container 100, whereas, in the case of the ink container 100 in FIG. 11(*b*), its electrical contact is located close to the top of the ink container 100. Assuming that the two ink containers are equal in the amount of force to be applied thereto in the direction indicated by an arrow mark A in the drawing in order to mount them in the holders, the contact pressure generated between the ink container in FIG. 11(*a*) and the holder is greater than the contact pressure generated between the ink container in FIG. 11(*b*) and the holder. On the other hand, in the case of the ink container in FIG. 11(*a*), its electrical contact 101 is closer to the ink outlet 100A, being therefore higher in the likelihood of being contaminated, than the electrical contact 101 of the ink container in FIG. 11(*b*).

More specifically, a small amount of the ink from the ink container 100 is scattered when the ink container 100 is mounted or dismounted, and also, during a recording operation. The scattered ink is likely to adhere to the bottom of the ink container 100, and bottom portions of the side walls of the ink container 100. Further, there is the possibility that the ink having adhered to the interior of the holder will rise to the electrical contact 101 because of the capillary force which is generated as the ink adheres to the corners (joints between the front wall and side walls) of the ink container. As the ink adheres to the electrical contact 101, it is possible that the ink will change the resistance of the contact area, through which electrical contact is established between the storage element 101 and the counterpart of the holder, causing the storage element 101 to malfunction. In addition, in the case of a storage element having two or more electrical contacts 101, there is the possibility of a short circuit. There is also the possibility that the ink having adhered to the electrical contacts 101 will increase in viscosity due to the evaporation of its volatile ingredients, adversely affecting the electrical connection between the storage element 100 and the counterpart of the holder.

In other words, for the purpose of securing a proper amount of contact pressure at the electrical contact 101, the electrical contact 101 is desired to be located closer to the bottom of the ink container 100, whereas for the purpose of preventing the electrical contact 101 from being contaminated by the scattered ink, the electrical contact is desired to be located closer to the top of the ink container 100.

FIGS. 12 and 13 show hypothetical ink containers which are equipped with a storage unit 102 structured as shown in FIG. 14, and which are made different in the location of the storage unit 102 for the purpose of describing the effect of the location of the storage unit 102.

The storage units 102 in these drawings are provided with a storage element 102A, and a connective pad 102B as an electrical contact. The storage unit 102 in FIG. 13 is located at a level higher than those in FIGS. 12(*a*) and 12(*b*); it is located farther from the ink outlet 100A than those in FIGS. 12(*a*) and 12(*b*). The holder 120 is provided with a connector 124, which is attached to the portion of the connector 124, which corresponds in location to the connective pad 10B of the storage unit 102. The connector 124 is provided with a contact terminal 124A, in the form of a brush, as an electrical contact.

If the ink container 100 fails to be completely mounted in the ink container holder 120, it is possible that the ink container 100 will remain tilted in the ink container holder, with the corner of the top wall 100D stuck at a point between the top and bottom (front and rear) ends of the curved portion 122A of the overhang portion 122 of the holder 120 as shown in FIG. 12(*a*). In such a case, it is possible that the ink outlet 100A of the ink container 100 will not be properly engaged with the ink tube 121, causing the ink to be inadequately supplied, more specifically, allowing air to enter the ink tube. Further, since the ink container 100 remains tilted in the ink container holder 120, it is possible that the ink container 100 will partially stick out of the holder 120. Thus, if a recording operation is carried out with the ink container 100 in the above described condition, a part of the ink container 100 will come into contact with the internal structure of the recording apparatus, which might result in damage to the recording apparatus and, ink container 100, and also, damage to recorded images. When the ink container 100 has failed to be completely mounted in the holder, as shown in FIG. 12(*a*), the connective pad 102B of the storage unit 102 fails to come into contact with the contact terminal 124A of the connector 124, making it impossible to obtain data from the storage element 16. Thus, when data cannot be obtained from the storage element 16, it is determined that the ink container 100 has failed to be completely mounted, and a user is informed of the incomplete mounting of the ink container 100 and the need for remounting of the ink container 100.

However, if the ink container 100 is mounted as shown in FIG. 12(*b*), that is, virtually completely, except for being tilted at a very small angle, it is possible that the connective pad 102B will fall into the moving range of the contact terminal 124A, that is, the connective pad 102B will come into contact with the contact terminal 124A. Even if the contact between the connective pad 102B and contact terminal 124A is very slight, data can be obtained, making it impossible to detect the incomplete mounting of the ink container 100.

On the other hand, when the storage unit 102 is located as shown in FIG. 13, that is, it is located far away from the ink outlet 18, more specifically, as far away as possible from the rotational center, about which the ink container 100 is rotated as it is mounted into the holder, even if the angle at which the ink container 100 is incompletely mounted is very small, the distance between the connective pad 102B and contact terminal 124A becomes substantial; the connective pad 102B does not come into contact with the contact terminal 124A. Therefore, the incomplete mounting of the ink container 100 can be detected. However, the distance the connective pad 102B must be moved relative to the contact terminal 124A in order for the pad 102B and terminal 124A to be placed in contact with each other, becomes greater, making greater the possibility that the contact terminal 124A will accidentally come into contact with the portion of the ink container 100 outside the boundary of the connective pad 102B.

For example, in the case of the ink container 100, shown in FIG. 14, the storage unit 102 of which is attached in the recess 100E of the storage unit 102, there is the possibility that when the ink container is mounted into, and dismounted from, the ink holder 120, the contact terminal 124A will encounter the gap between the wall of the recess 100E and the storage unit 102, as shown in FIGS. 14(*a*) and 14(*b*). More specifically, when the ink container 100 is mounted, the contact terminal 124A comes into contact with the storage unit 102 in a manner of rubbing the storage unit 102 upward, encountering thereby the gap, whereas when the ink container 100 is dismounted, the contact terminal 124A becomes separated from the storage unit 102 in a manner of rubbing the storage unit 102 downward, also encountering the gap. Therefore, it is possible that when the ink container 100 is mounted or dismounted, the contact terminal 124A will hang up in the gap between the wall of the recess 100E and the storage unit 102, becoming thereby damaged. Further, if the recess 100E is expanded downward as shown in FIG. 15, there is the possibility that when the ink container 100 is mounted, the contact terminal 124A will come into contact with the corner 102C-1 of the substrate C of the storage element 102 as shown in FIGS. 15(*a*) and 15(*b*), and also, that when the ink container 100 is removed, the contact terminal 124A will come into contact with the corner 124A-1 of the recess 100E as shown in FIGS. 15(*c*) and 15(*d*). Therefore, it is possible that when the ink container 100 is mounted or dismounted, the contact terminal 124A will be damaged.

Moreover, if the ink container 100, the recess 100E of which is shown in FIG. 14 or 15, and is located close to the top of the ink container 100 in order to position the storage unit 102 close to the top of the ink container 100, is manufactured by injection molding, the ink capacity of the ink container 100 substantially reduces due to the structure of the metallic molds. More specifically, when injection molding the container proper of the ink container 100, which is open at the top, the portion 100G of the wall 100F (FIG. 14(*a*)) of the container proper, which corresponds in position to the recess 100E, bulges inward. Since the mold is extracted upward, the thickness of the portion of the wall 100F between the portion 100G and the bottom of the container proper is the same as the thickness T of the portion 100G. Thus, the higher the location of the recess 100E relative to the ink container 100, the longer the portion of the wall 100F of the ink container 100, the thickness of which is the same as the thickness T of the inwardly bulging portion 100G, and therefore, the smaller the ink capacity of the ink container 100 by an amount equal to the amount by which the volume of the wall 100F is increased by the inward bulging of the wall portion 100G. In addition, in the case of an ink container filled with an ink retaining member (ink absorbent member), the ink retaining member is compressed by the bulging portion 100G, being reduced in ink capacity, which in turn reduces the ink capacity of the ink container 100.

SUMMARY OF THE INVENTION

Thus, the primary object of the present invention is to provide a combination of an ink container and an ink container holder, the electrical contacts of which are optimized in position in consideration of the reliability in the electrical connection between the ink container and ink container holder, and also, in consideration of the possibility of the ink adhesion.

According to one of the aspects of the present invention made to accomplish the above described object, an ink container, which is provided with an ink outlet through which the ink stored in the container proper of the ink container is delivered, and a storage unit comprising a substrate attached to the front surface of the container proper, electrical contacts, and a storage element electrically connected to the electrical contacts, is characterized in that the electrical contacts are located farther from the ink outlet than the storage element.

According to another aspect of the present invention, the electrical contacts of the ink container are located farther from the ink outlet than the storage element, in consideration of the ink adhesion. Therefore, the electrical contacts of an ink container and the contact portion of an ink container holder are optimally positioned relative to each other and the ink container, while assuring that the electrical connection is reliably maintained between the electrical contacts of the ink container and the electrical contact portion of the ink container holder.

According to another aspect of the present invention, the ink container holder is provided with a member for protecting the connector of the ink container holder. Therefore, not only is the ink prevented from adhering to the connector and its adjacencies, but also, the contact terminals of the connector are prevented from being damaged. Therefore, satisfactory electrical connection is always maintained between the ink container and ink container holder.

According to another aspect of the present invention, the electrical contacts of the ink container are placed on the front surface of the substrate, and the storage unit is placed on the rear surface of the substrate. Therefore, the electrical contacts of the ink container can be place as far away as possible from the ink outlet, assuring that the incomplete mounting of the ink container can be detected, while minimizing the possibility of the ink adhesion, and also, making it possible to reduce in size the portion of the wall of the ink container made to bulge inward to accommodate the storage unit, in order to minimize the reduction of the ink capacity attributable to the presence of the bulge.

According to another aspect of the present invention, the electrical contacts of the storage unit are placed on the front surface of the substrate so that they overlap with the storage element mount on the rear surface of the substrate, in terms of the direction parallel to the surfaces of the substrate. Therefore, the substrate can be reduced in size, making it possible to reduce in size and cost the storage unit comprising the substrate, storage element, and electrical contacts.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 4(*b*), a perspective view of the ink jet cartridge, shown in FIG. 4(*a*), in which two of the ink containers shown in FIG. 1 have been mounted; FIG. 4(*c*) is a perspective view of the ink jet cartridge as seen from below.

DETAILED DESCRIPTION OF THE PREFERRED EMBODIMENTS

Hereinafter, the preferred embodiments of the present invention will be described with reference to the appended drawings.

(Embodiment 1)

Figure 1:
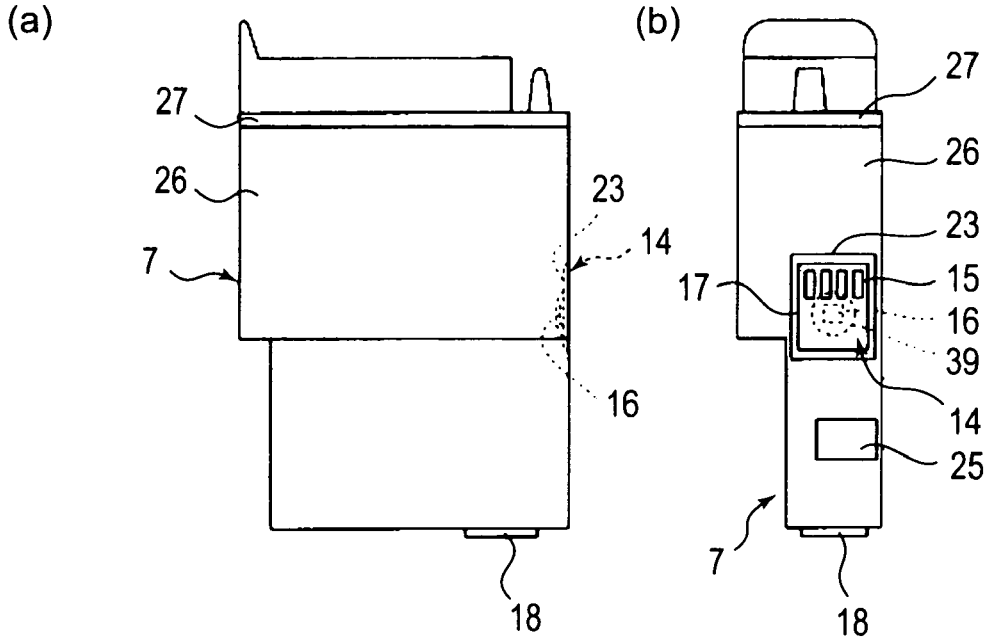
FIGS. 1(*a*) and 1(*b*) are front and side views, respectively, of the ink container in the first embodiment of the present invention.

FIGS. 1(*a*) and 1(*b*) are front and side views of the ink container 7 in the first embodiment of the present invention. This ink container 7 is provided with a storage unit attachment recess 23, which is a part of the side wall of the ink container 7 perpendicular to the bottom wall of the ink container 7 having an ink outlet 18. In this recess 23, a storage unit 14 is attached. More specifically, the storage unit 14 is attached to the bottom of the recess 23 so that the outward surface of the storage unit 14 becomes flush with the outward surface of the side wall of the ink container 7. The storage unit 14 comprises: a substrate 17 holding wiring on both the front and rear surfaces, a storage element 16 mounted on the rear surface of the substrate 17; and connective pads 15 placed on the front surface of the substrate 17. The storage element 16 is capable of storing the information regarding the ink container and the ink therein, for example. Storable also in the storage element 16 are the data regarding the amount of the ink remaining in an ink container, and the data specific to the ink container to which the storage element 16 is attached. A referential number 39 designates a sealing member for sealing the storage element 16, and the connective pads 15 are for establishing electrical connection between the storage element 16 and a connector 19 by being placed in contact with the contact terminals 20 (FIG. 5) of the connector 19 of the ink container holder 1.

Figure 3:
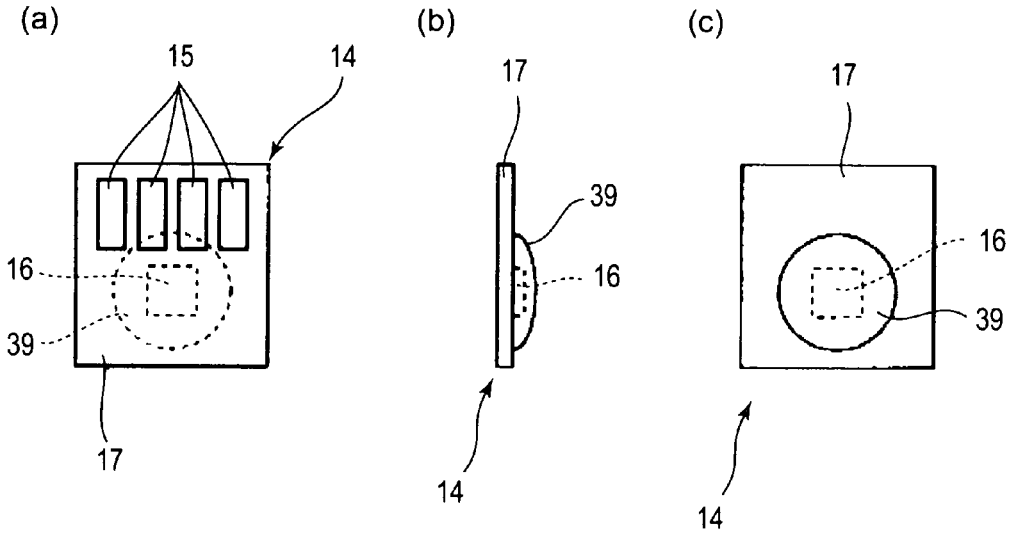
FIGS. 3(*a*), 3(*b*), and 3(*c*) are front, side, and rear views, respectively, of the storage unit in FIG. 1.

The storage unit 14 is provided with a plurality of connective pads 15, which are located on the opposite side of the substrate 17 from the ink outlet 18, that is, closer to the top end of the substrate 17, being on the top side of the storage element 16. More specifically, the connective pads 15 are placed on the substrate 17 so that as the storage unit 14 is attached to the ink container, they will be positioned on the opposite side of the substrate 17 from the ink outlet 18, and the storage element 16 is placed on the substrate 17 so that as the storage unit 14 is attached to the ink container, it will be positioned on the ink outlet 18 side of the substrate from the center of the substrate 17 in terms of the vertical direction (FIGS. 3(*a*), 3(*b*), and 3(*c*)). The storage element mount of the substrate 17 includes the sealing member 39. The storage element mount partially overlaps with the connective pads 15, as shown in FIG. 3(*a*), as seen from the direction perpendicular to the substrate 17.

Figure 2:
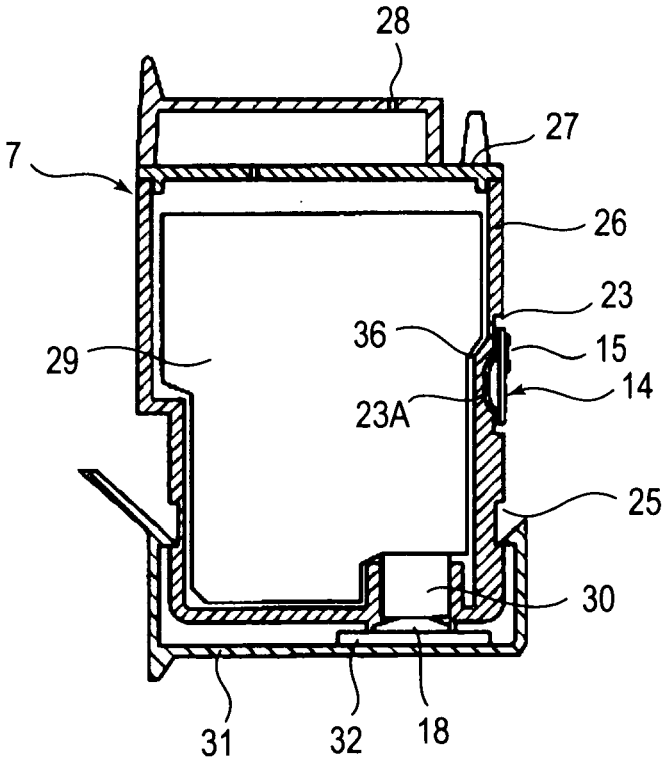
FIG. 2 is a sectional view of the ink container shown in FIG. 1.

FIG. 2 is a sectional view of the ink container 7. The ink container 7 comprises a container proper 26, and a lid 27 welded to the edge of the top opening of the container proper. In the container proper 26, an ink holding member 29 for holding ink, and an ink guiding member 30 for guiding the ink held in the ink holding member 29 to the ink outlet 18, are located. The ink container 7 also comprises a cap attachment recesses 25, which are parts of the side wall of the ink container 7. The recesses 25 are where the ink container cap 31 latches to prevent the ink in the ink container 7 from evaporating through the ink outlet 18. Designated by a referential number 32 is a rubber seal attached to the ink container cap 31 to seal the joint between the ink outlet 18 of the ink container 7, and the ink tube of the holder.

Figure 4:
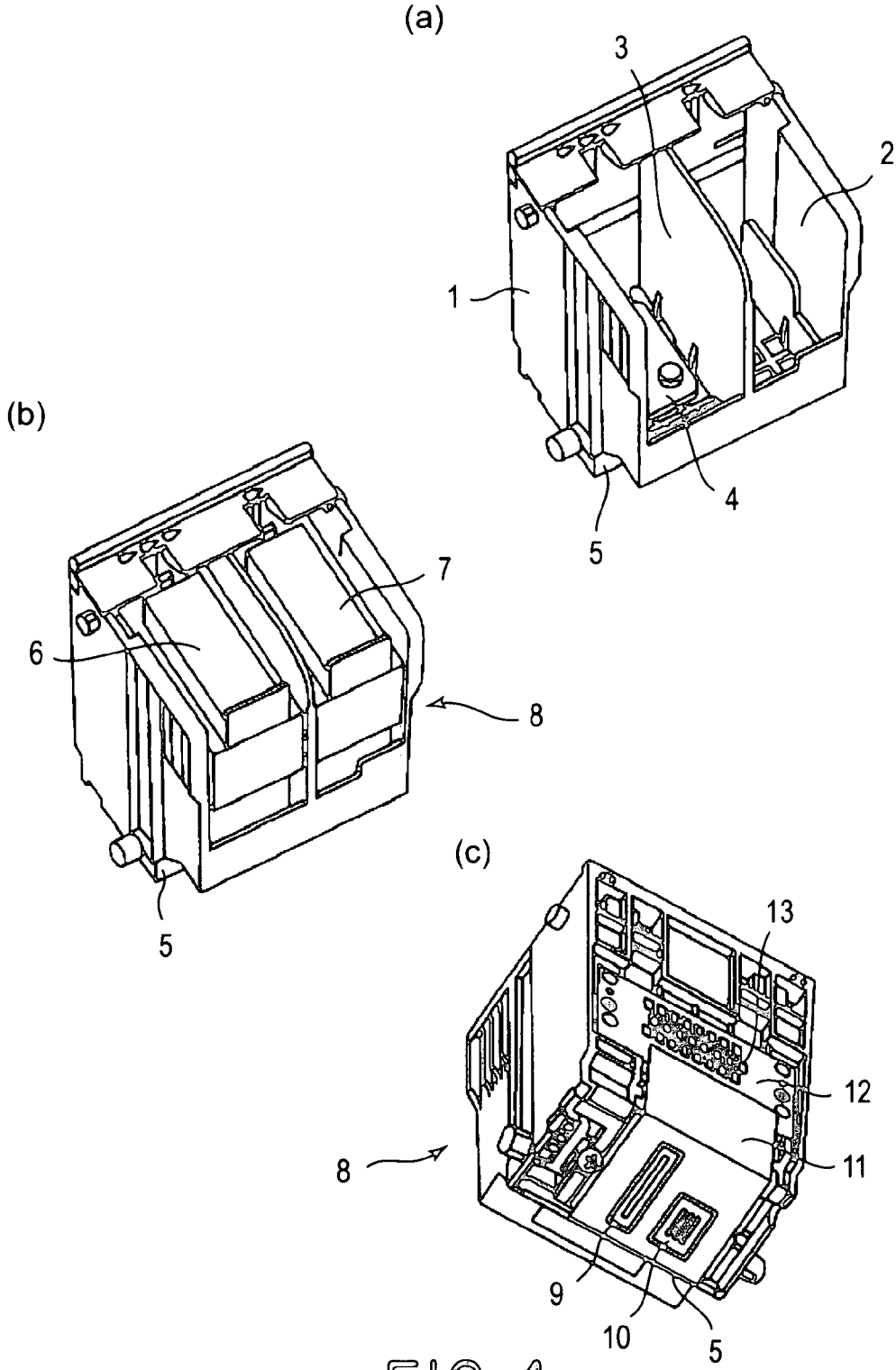
FIG. 4(*a*) is a perspective view of an ink jet cartridge in which the ink container shown in FIG. 1 is mountable.
Figure 5:
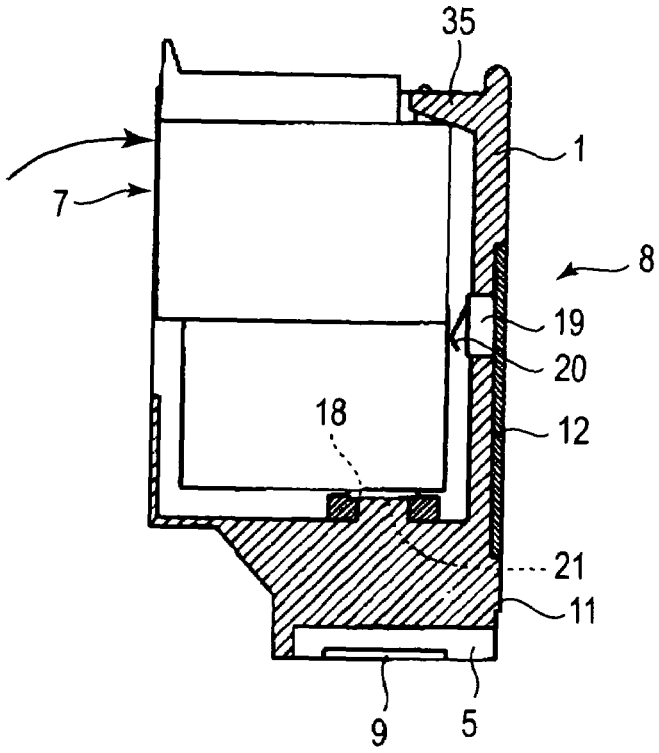
FIG. 5 is a sectional view of the ink jet cartridge shown in FIG. 4, in which the ink container has been normally mounted.

FIGS. 4 and 5 are drawings which depict an example of an ink jet cartridge 8 in accordance with the present invention. FIG. 4(*a*) is a perspective view of the ink container holder 1, which comprises an ink jet recording head 5, and into the container compartment of which an ink container is removably mountable. The holder 1 comprises a black ink container compartment 2 and a color ink container compartment 3. FIG. 4(*b*) is a perspective view of the ink jet cartridge 8. The black ink container 7 (which hereinafter may be referred to as black container), and the color ink container 6 (which hereinafter may be referred to as color container) which holds yellow, magenta, and cyan inks, are mounted into the compartments 2 and 3, respectively, of the holder 1; the combination of the holder 1 and black and color containers make up the ink jet cartridge 8.

FIG. 4(*c*) is a perspective view of the ink jet cartridge 8 as seen from below. The ink jet recording head 5 is provided with a black ink ejecting portion 9 enabled to eject the black ink supplied from the black container 7, and a color ink ejecting portion 10 enabled to eject yellow, magenta, and cyan inks supplied from the color container 6. The recording elements of the ink ejecting portions 9 and 10 are connected to a circuit board 12 by the flexible cable 11.

As the ink jet cartridge 8 is mounted onto the carriage of a recording apparatus of a serial scan type, the connective pads 13 of the circuit board 12 become connected to the unshown control circuit of the main assembly of the recording apparatus. Upon reception of the drive signals from the recording apparatus of a serial scan type, the recording elements corresponding to the received drive signals eject ink through the ink ejecting portions 9 and 10. As for the recording elements, electrothermal transducers (heater), piezoelectric elements, etc., can be used. When electrothermal transducers are employed, ink can be made to bubble by the heat generated by the electrothermal transducers, so that ink is ejected from the ink ejecting portions 9 and 10 by the energy from the bubbles. A recording apparatus of a serial scan type records an image on recording medium by alternately repeating the operation which ejects ink from the recording head 5 while moving the ink jet cartridge, along with the carriage, in the primary scanning direction, and the operation which moves the recording medium in the secondary direction intersectional to the primary scanning direction.

Figure 10:
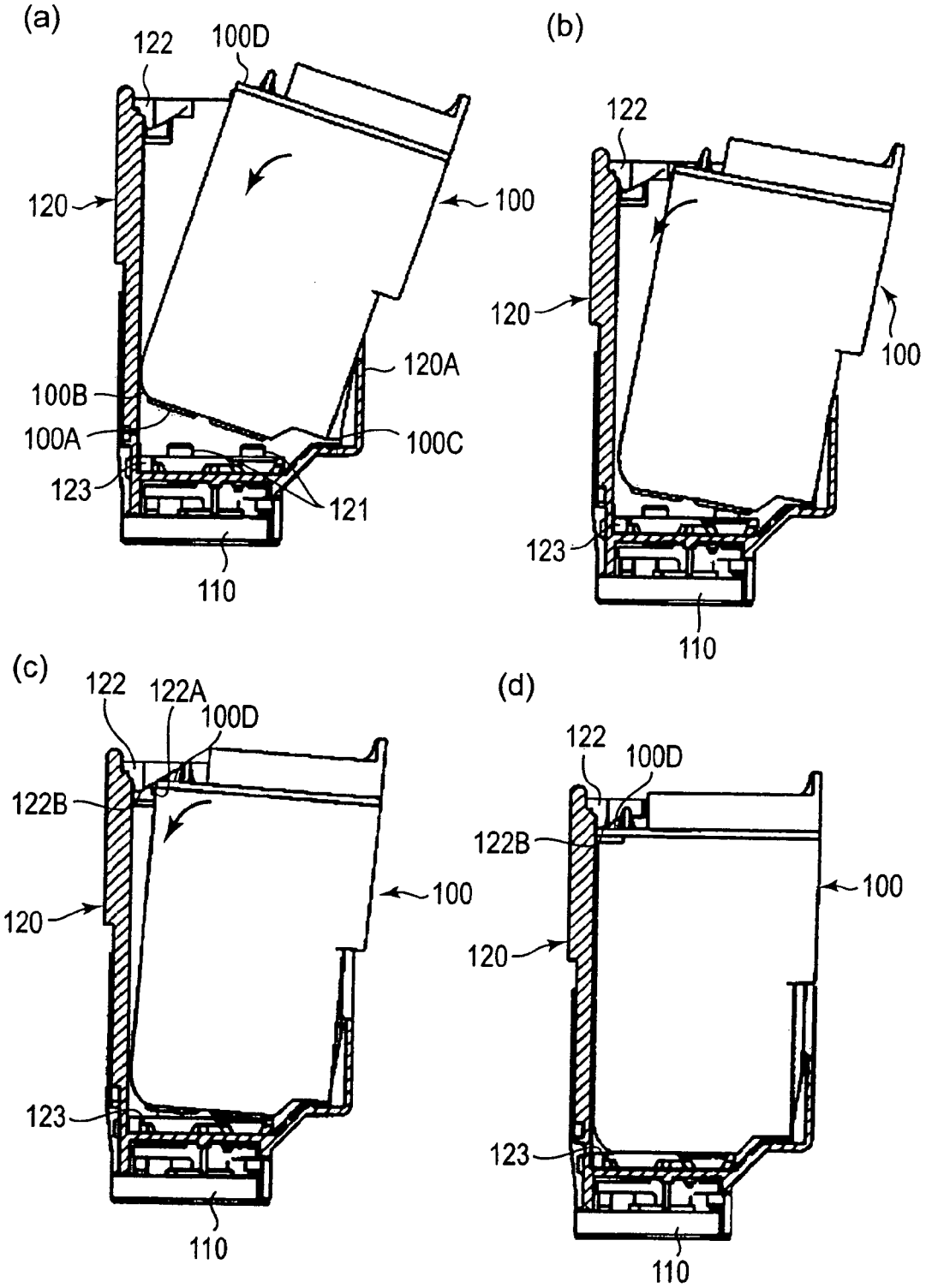
FIG. 10 (PRIOR ART)
FIGS. 10(*a*), 10(*b*), 10(*c*), and 10(*d*) are schematic drawings for depicting the movement of an ink container in accordance with the prior art, made during the mounting of the ink container into the ink container holder.
Figure 11:
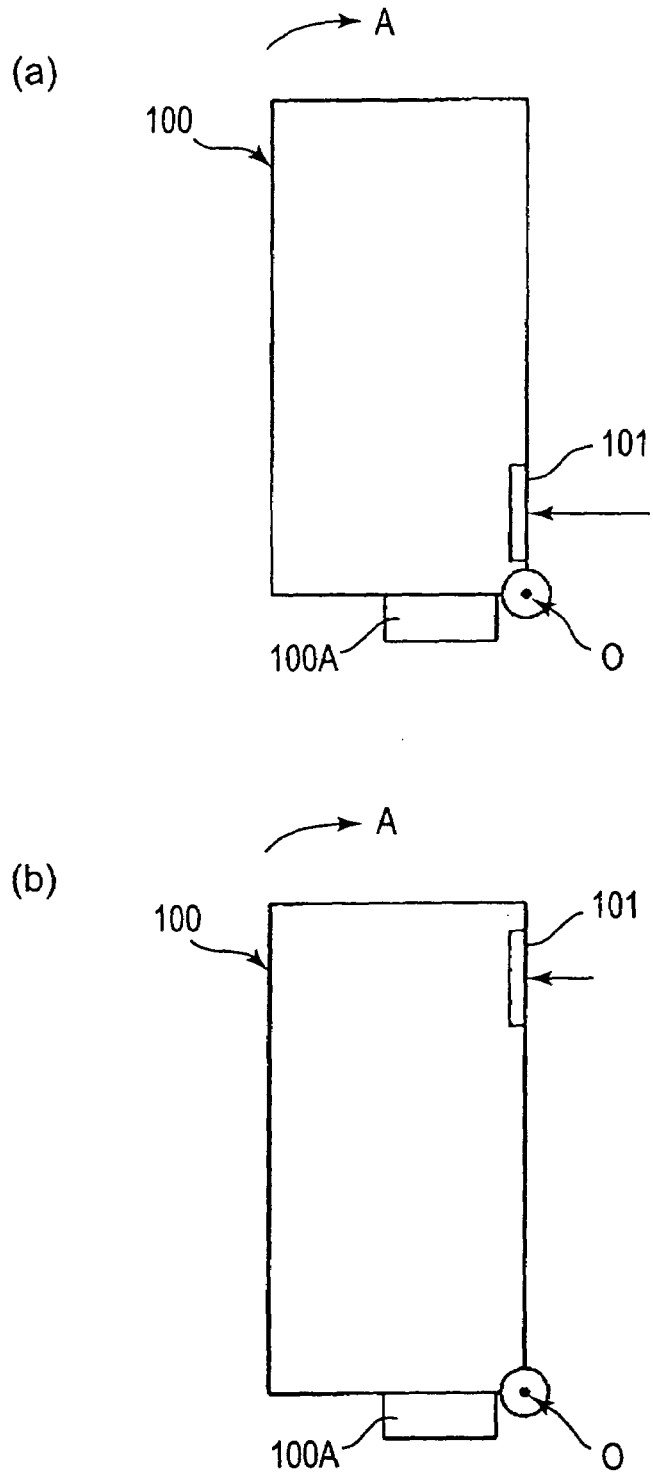
FIG. 11 (PRIOR ART)
FIGS. 11(*a*) and 11(*b*) are schematic drawings for hypothetically depicting the effect of the positional relation between the rotational center of the ink container and the electrical contact of the ink container.
Figure 12:
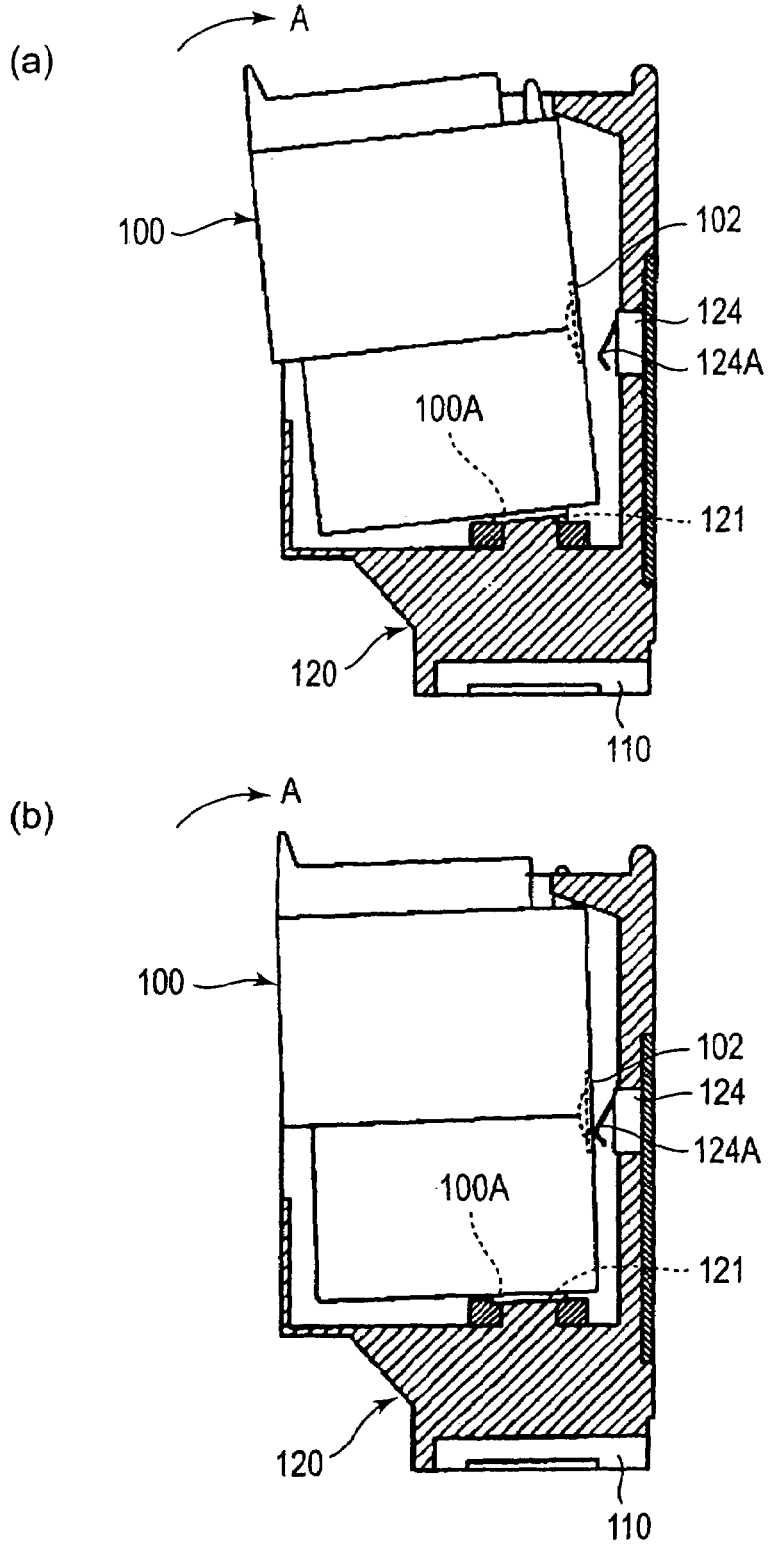
FIG. 12 (PRIOR ART)
FIGS. 12(*a*) and 12(*b*) are schematic sectional views of al ink container having a storage unit, which has hypothetically failed to be completely mounted.
Figure 13:
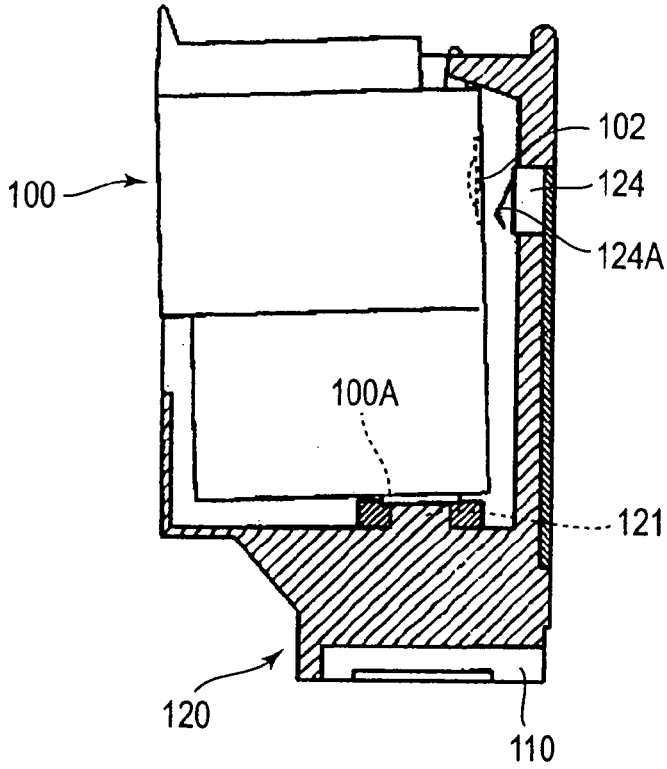
FIG. 13 (PRIOR ART)
FIG. 13 is a schematic sectional view of the ink container, shown in FIG. 12, which has failed to be completely mounted.
Figure 14:
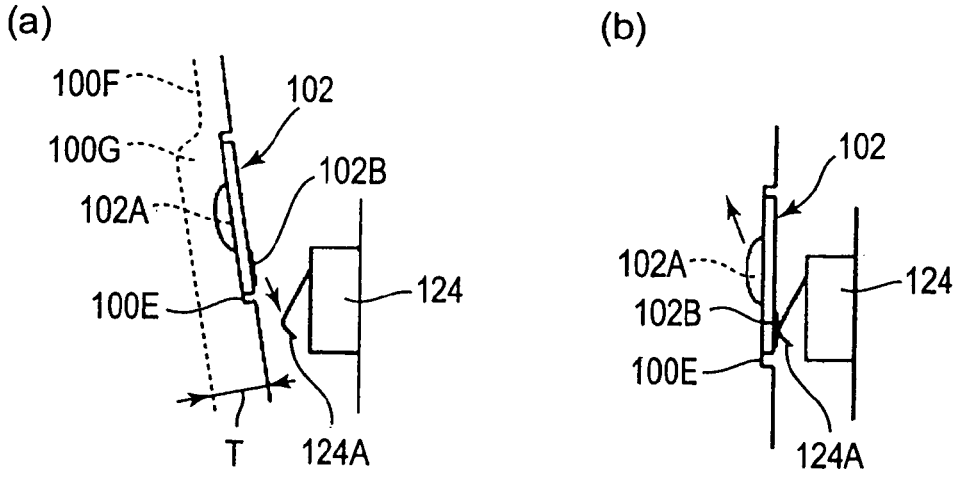
FIG. 14 (PRIOR ART)
FIGS. 14(*a*) and 14(*b*) are schematic drawings for depicting the movement of the ink container, shown in FIG. 12, made during the mounting and dismounting of the ink container.
Figure 15:
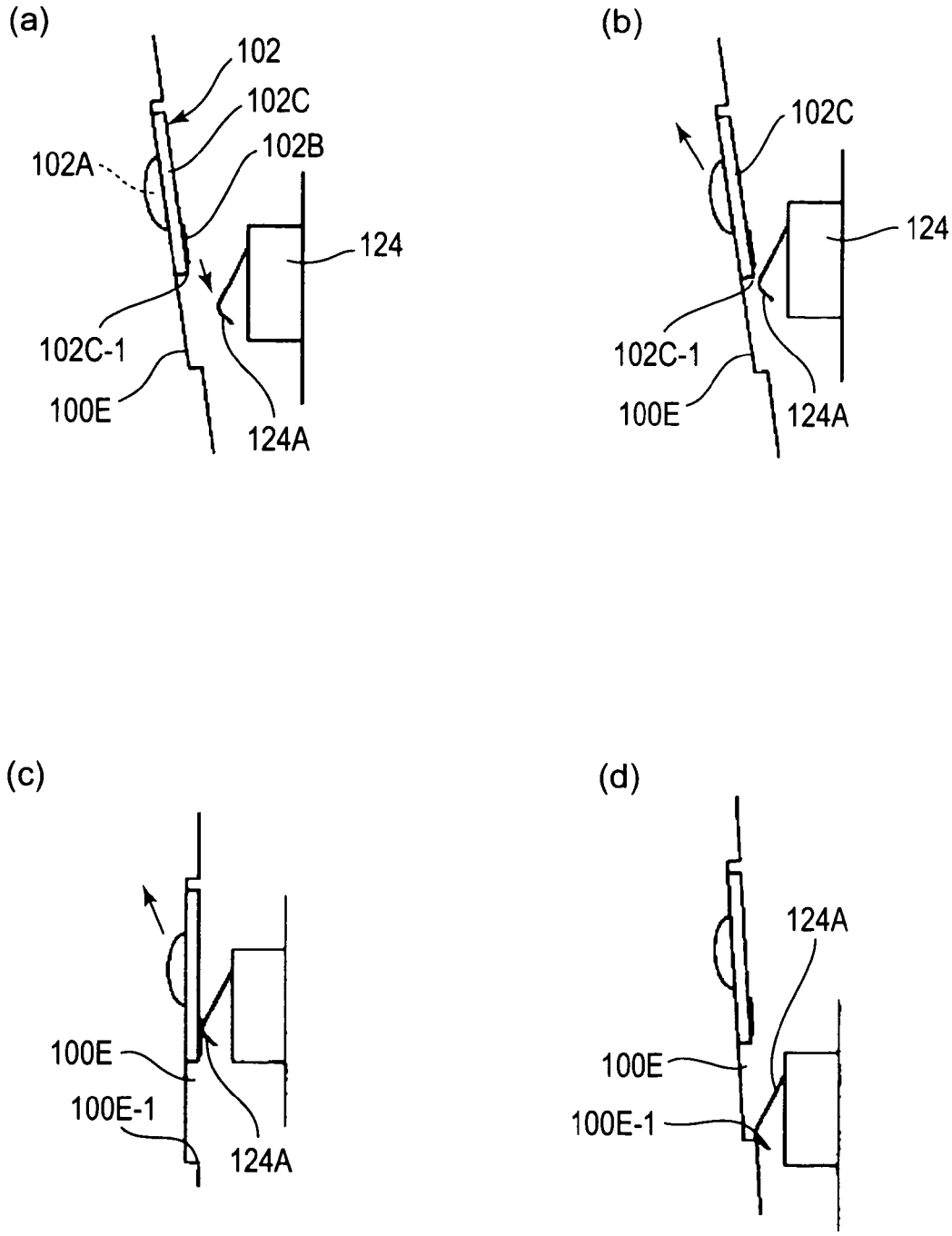
FIGS. 15(*a*), 15(*b*), 15(*c*), and 15(*d*) are schematic drawings for depicting the movements of the electrical contact and its adjacencies of the ink container, shown in FIG. 12, made during the mounting and dismounting of the ink container.

FIG. 5 is a sectional view of the ink jet cartridge 8, into the ink container holder 1 of which the ink container has been properly mounted. The mounting of the ink container 7 into the holder 1 also involves such a rotational movement of the ink container 7 as the above described rotational movement of the ink container shown in FIG. 10. That is, as the ink container 7 is inserted into the holder 1, it is made to follow the downwardly facing slope of the ink container guiding portion 35 of the holder 1, being thereby rotated as indicated by an arrow mark in FIG. 5. When the ink container 7 is in the position shown in FIG. 5, the ink outlet 18 of the ink container 7 is correctly coupled with the ink inlet 21 of the ink jet recording head 5, making it possible for ink to be supplied to the ink jet recording head 5.

As the ink container 7 is correctly mounted into the holder 1, the connective pads 15 on the ink container side become connected with the contact terminals 20 of the connector 19 on the holder side. Then, the holder 1, into which the ink container 7 has been correctly mounted, is mounted onto the carriage of the recording apparatus. As a result, the electrical connection is established between the recording element 16 and the control portion of the recording apparatus, through these connective pads 15 and contact terminals 20.

Figure 6:
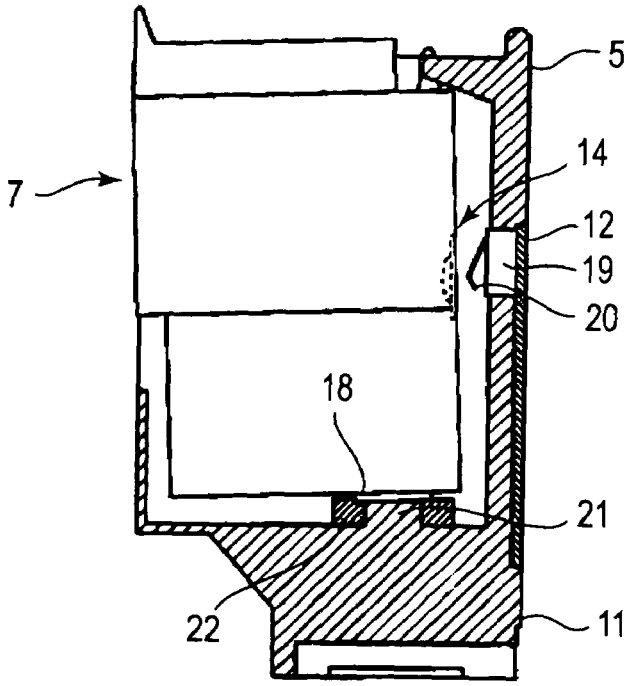
FIG. 6 is a sectional view of the ink jet cartridge, shown in FIG. 4, in which the ink container has been mounted at an angle.

FIG. 6 is a sectional view of the combination of the ink container 7 and holder 1, in which the ink container 7 has been mounted into the holder 1 at a slight angle. As described above, the connective pads 15 of the storage unit 14 are located on the portion of the substrate 17 close to the top of the substrate 17, that is, on the top side of the storage element 16. Therefore, if the ink container 7 remains slightly tilted as shown in FIG. 6, the connective pads 15 remain separated from the contact terminals 20, preventing the storage element 16 from being accessed for the data therein. Thus, whether or not the ink container 7 has been completely mounted can be determined by detecting whether or not the storage element 16 is accessible after the mounting of the ink container 7. For example, in the case of an ink container 7, the connective pads 15 of which are placed on the portion of the substrate 17 close to the bottom edge of the substrate 17, even if the ink container 7 is mounted in the holder 1 at a slight angle as shown in FIG. 6, that is, even if the ink container is incompletely mounted, there is the possibility that there will be physical contacts between the connective pads 15 and the contact terminals 20, making it impossible to detect the incomplete mounting of the ink container 7.

The bottom of the recess 23 of the container proper 26 is provided with a small recess 23A, which accommodates the storage element 16 and sealing member 39 located on the rear surface of the substrate 17. Thus, the portion of the wall of the container proper 26 having the small recess 23A is bulged inward to give this portion of the wall a thickness equal to that of the other portion of the wall of the container proper, creating thereby the bulge 36 (FIG. 2). When manufacturing the container proper 26 by injection molding, the mold is removed upward, requiring therefore the bulge 36 to extend to the bottom wall of the container proper 26. Therefore, the presence of the bulge 36 reduces the ink capacity of the ink container 7 by an amount equal to the volume of the bulge 36. The amount by which the ink capacity of the ink container 7 is reduced can be reduced by reducing the length by which the bulge 36 extends downward, and the length by which the bulge 36 extends downward can be reduced by reducing the distance between the storage element 16 and the bottom edge of the substrate 17, that is, by increasing the amount by which the storage element 16 is positioned lower than the connective pads 15. Therefore, even though the connective pads 15 are located as close as possible to the top edge of the substrate 17 in order to assure that the incomplete mounting of the ink container 7 can be detected, while preventing the contamination by ink, the ink container 7 is provided with a satisfactory ink capacity.

Figure 7:
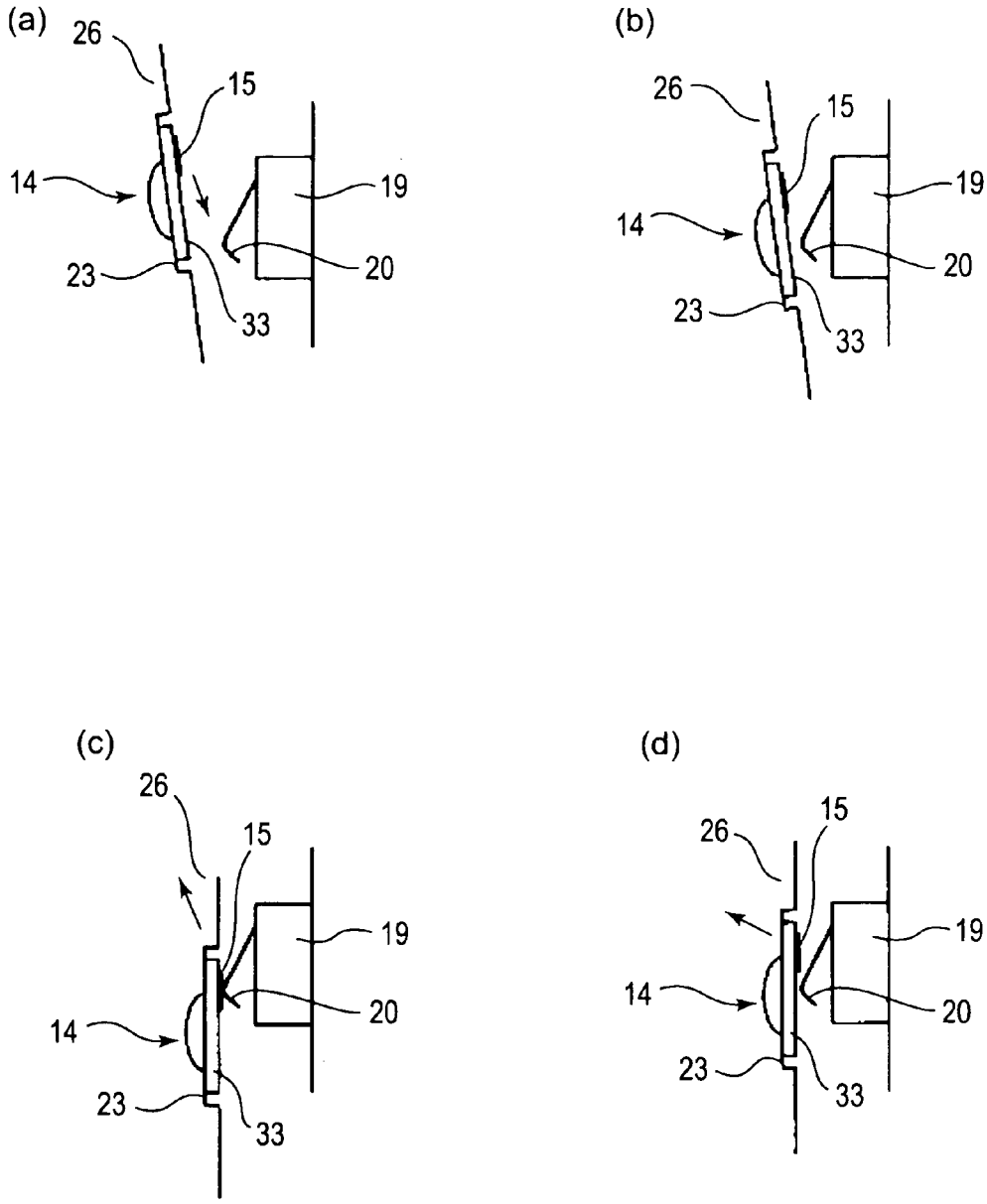
FIGS. 7(*a*), 7(*b*), 7(*c*), and 7(*d*) are schematic drawings for depicting the movement of the electrical contact of the ink container, made during the mounting and dismounting of the ink container.

FIG. 7 shows the movement of the connective pads 15 of the storage unit 14 toward the contact terminals 12 of the connector 19, made during the mounting of the ink container 7 (FIGS. 7(*a*) and 7(*b*)), and the movement of the connective pads 15 of the storage unit 14 away from the contact terminals 12 of the connector 19, made during the dismounting of the ink container 7 (FIGS. 7(*c*) and 7(*d*)). During the mounting of the ink container 7, first, the contact terminals 20 come into contact with the flat portion 33 of the substrate 17, slide on the flat portion 33, and then, come into contact with contact pads 15, as shown in FIG. 7(*b*). During the dismounting of the ink container 7, the contact terminals 20 become separated from the connective pads 15, briefly slide on the flat portion 33, and become completely separated from the storage unit 14, as shown in FIG. 7(*d*). Therefore, the front surface of the substrate 17, that is, the opposite surface of the substrate 17 from the surface of the substrate on which the storage element 16 is located, is utilized as the portion for guiding the contact terminals 20, preventing thereby the contact terminals 20 from colliding with the top edge of the recess 23 and the corner of the substrate 17 Therefore, the contact terminals 20 are not damaged by the top edge of the recess 23 and the corner of the substrate 17. As will be evident from the above description of this embodiment, this embodiment makes it possible to prevent the contact terminals 20 from colliding with the portions of the ink container 7, by which the contact terminals 20 might be damaged, should the contact terminals 20 collide with them.

(Embodiment 2)

Figure 8:
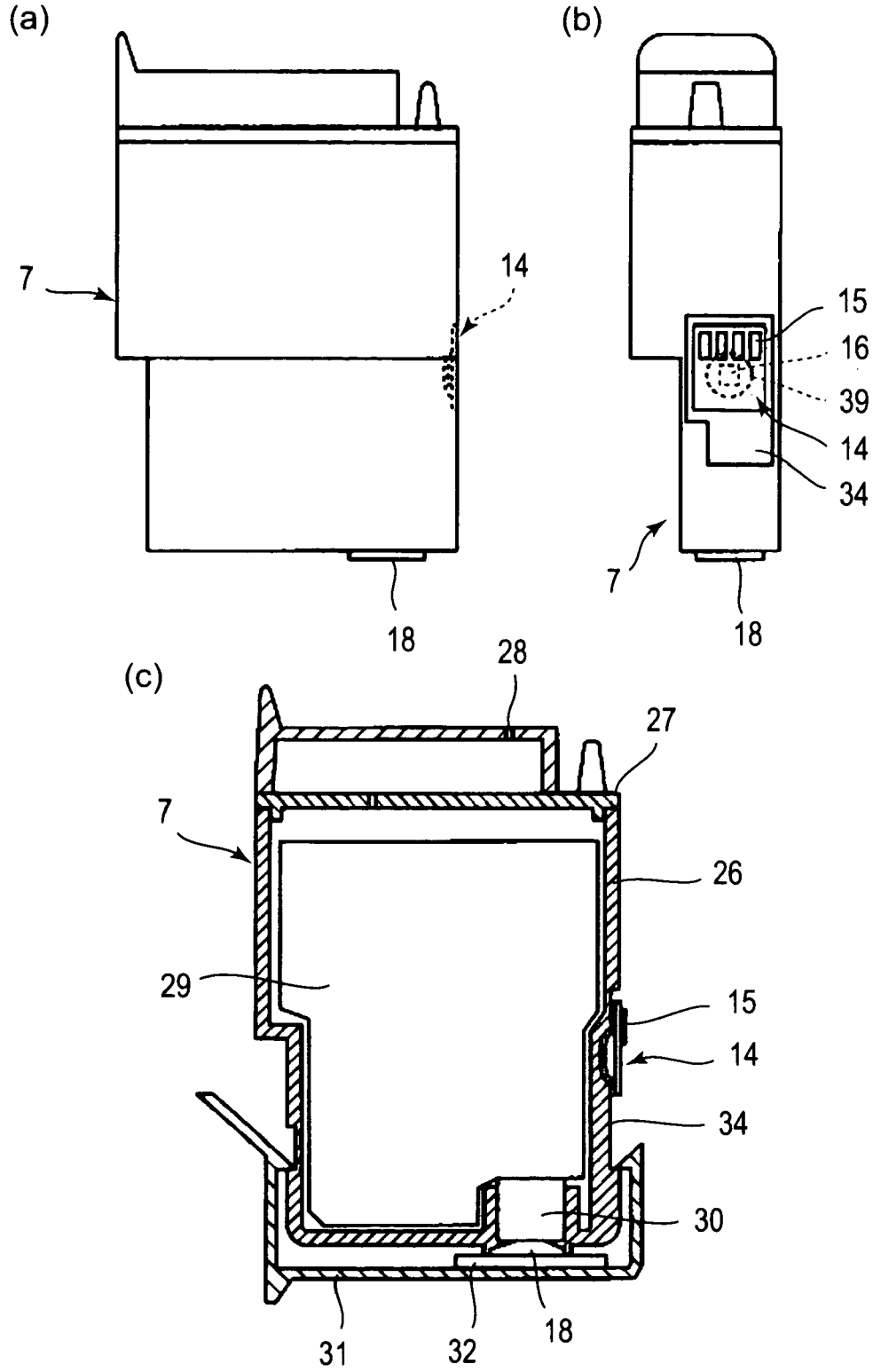
FIGS. 8(*a*), 8(*b*), and 8(*c*) are front, side, and sectional views, respectively, of the ink container in the second embodiment of the present invention.

FIGS. 8(*a*), 8(*b*), and 8(*c*) are front, side, and sectional views of the ink container 7 in the second embodiment of the present invention. The ink container 7 in this embodiment is provided with a recess 34, which is a part of one of the side walls of the container proper 26 perpendicular to the bottom wall of the ink container 7 having the ink outlet 18, and which serves not only as the recess in which the storage unit is attached, but also, as the recess, with the top edge of which the ink container cap 31 latches. The reduction in the ink capacity of the ink container 7 attributable to the provision of the storage unit attachment recess, and the recess, with the top edge of which the ink container cap 31 latches, can be reduced by reducing the distance between the two recesses. Further, the reduction in the ink capacity of the ink container 7 attributable to the provision of the two recesses can be further reduced by uniting the two recesses, as in this embodiment, in order to further reduce the distance from the storage element mount to the ink outlet 18.

Figure 9:
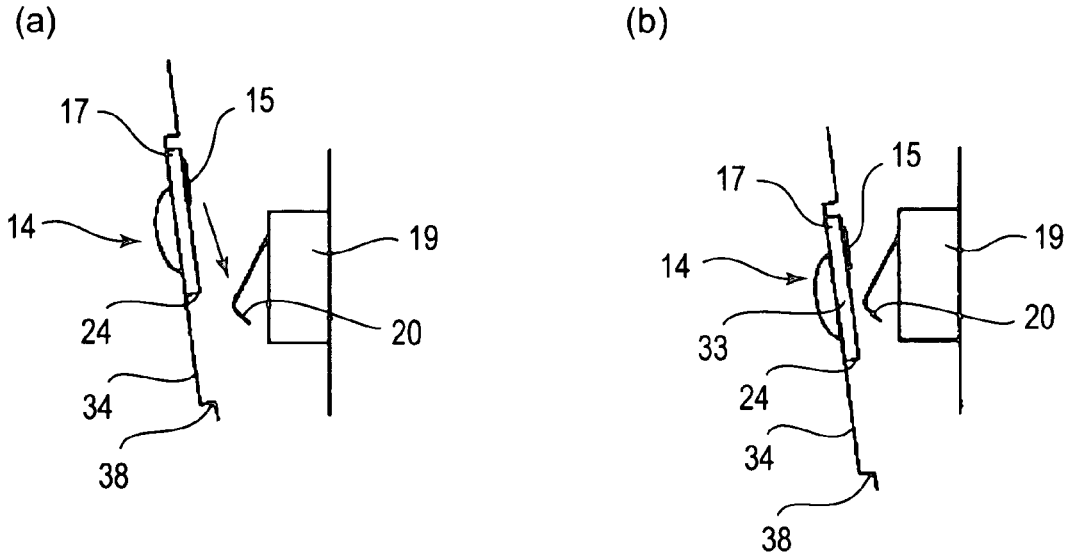
FIGS. 9(*a*) and 9(*b*) are schematic drawings for depicting the movement of the electrical contact of the ink container, shown in FIG. 8, made during the mounting and dismounting of the electrical contact.

With the employment of this structural arrangement, when mounting or dismounting the ink container 7, the contact terminals 20 do not come into contact with the corner 24 of the substrate 17, and the corner 38 of the recess 34, as shown in FIG. 9, being thereby prevented from being damaged by the corners. More specifically, during the mounting of the ink container 7, first, the contact terminals 20 come into contact with the flat portion 33 of the substrate 17, slide on the flat portion 33, and then, come into contact with the connective parts 15, being prevented thereby from coming into contact with the corner 24 of the substrate 24. Similarly, during the dismounting of the ink container 7, first, the contact terminals 20 become separated from the connective pads 15, briefly slide on the flat portion 33, and then, become completely separated from the ink container 7. Therefore, the contact terminals 20 are not damaged during the mounting and dismounting of the ink container 7.

(Embodiments 3 and 4)

Figure 17:
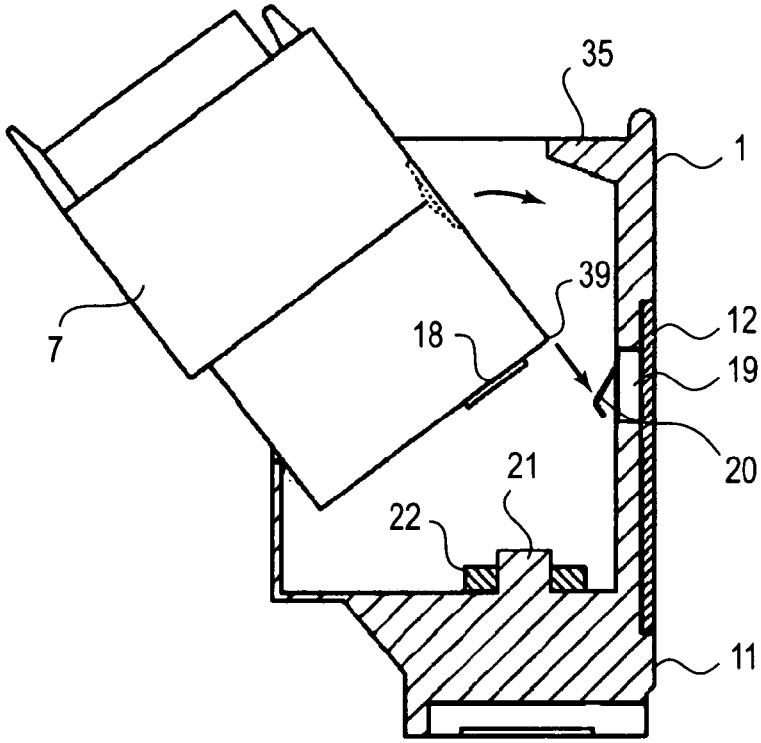
FIG. 17 is a sectional view of the ink container, in the first embodiment of the present invention, being mounted into a holder.

FIG. 17 is a sectional view of the combination of an ink container 7 having a storage unit, and an ink container holder 1, in which the former is being mounted into the latter. If the ink container 7 is insert into the holder 1 at a certain angle, the corner 39 of the ink container 7, which is close to the ink outlet 18 of the ink container 7, sometimes comes into contact with the contact terminals 20 of the connector 19, damaging thereby the contact terminals 20, although the occurrence of such an incident is very rare.

Figure 18:
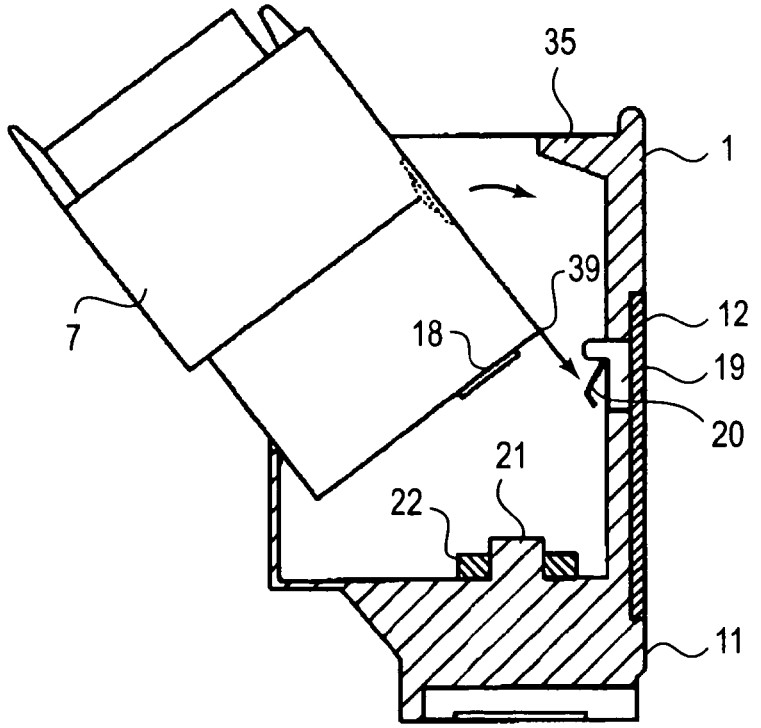
FIG. 18 is a sectional view of the ink container which is being mounted into the holder having a connector provided with a rib.

Also, if the ink container 7 is inserted into the holder 1 at a certain angle, the ink adhering to the adjacencies of the ink outlet 18 of the ink container 7 comes into contact with the contact terminals 20, adhering to (contaminating) the contact terminals 20, which sometimes results in the corrosion of the contact terminals 20 and/or the occurrences of short circuit. Therefore, if the connector 19 is provided with a rib 40 for protecting the contact terminals 20 during the mounting of the ink container 7 as shown in FIG. 18, the corner 39 of the ink container 7 comes into contact with the rib 40, correcting thereby the attitude in which the ink container 7 is being mounted, before it comes into contact with the contact terminals 20. Therefore, the corner 39 rarely comes into contact with the contact terminals 20, and should the corner 39 come into contact with the contact terminals 20, the contact will not generate impact high enough to damage the contact terminals 20. In other words, the provision of the rib 19 improves the reliability of the connector 19.

Figure 16:
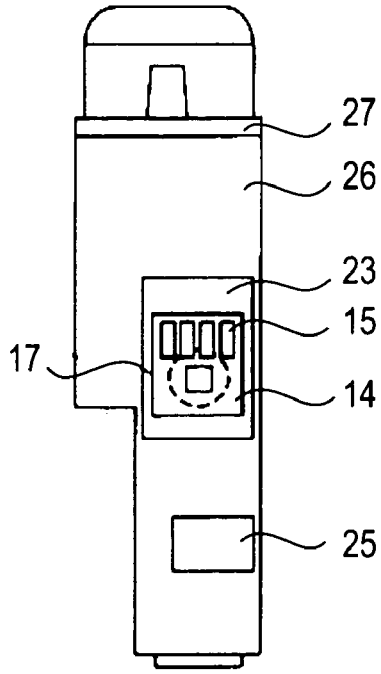
FIG. 16(*a*) is a side view of the ink container in the third embodiment of the present invention, and FIG. 16(*b*) is a side view of the ink container in the fourth embodiment of the present invention.
Figure 16:
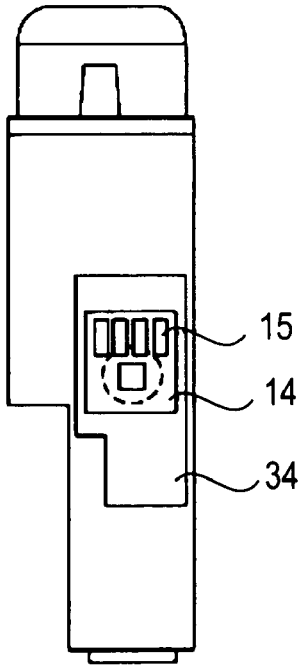
Figure 19:
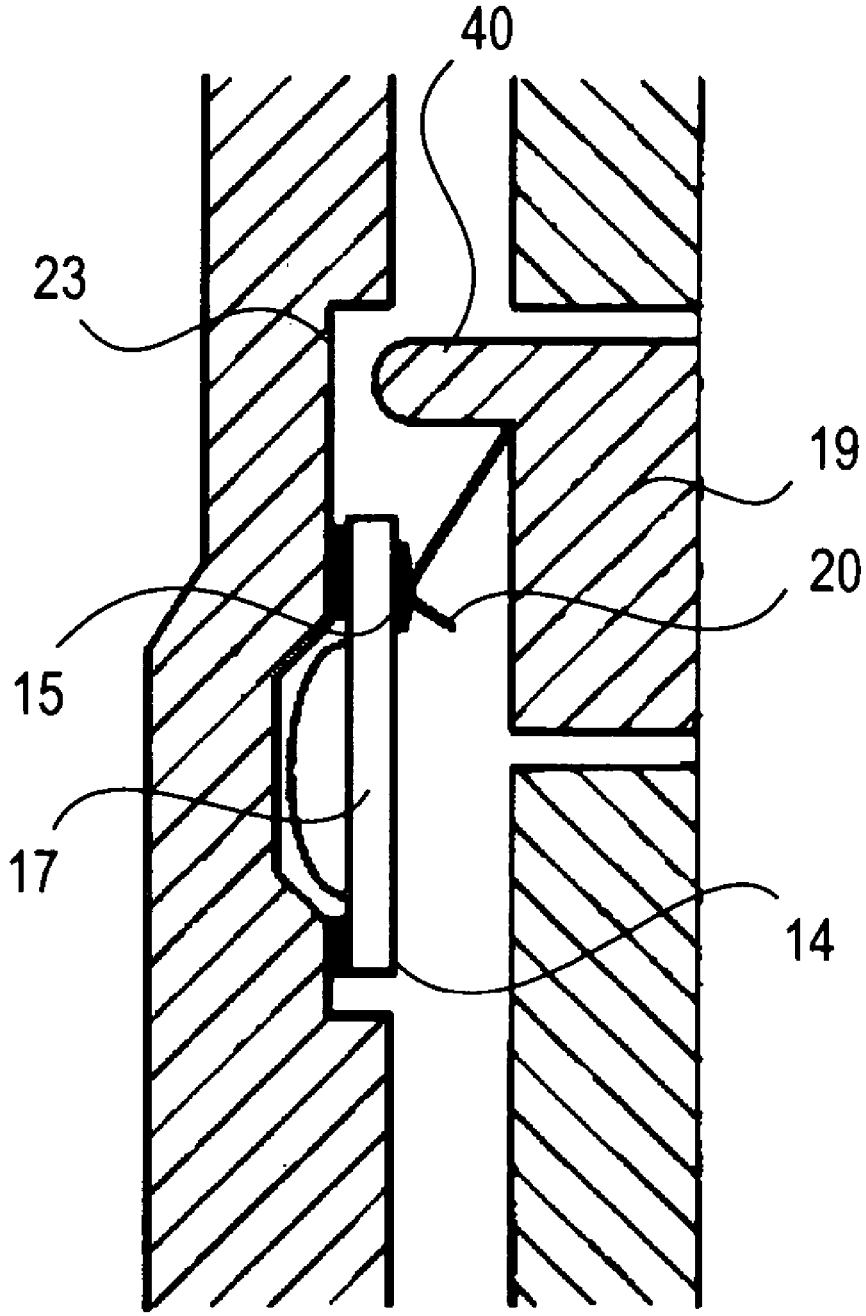
FIG. 19 is a schematic sectional view of the electrical junction between the ink container and ink container holder, in the third embodiment of the present invention, showing the state of the connection.

FIG. 19 is a schematic sectional view of the combination of the connector 19 of the holder 1, and the storage unit attachment recess of the ink container 7, corresponding in position to the connector 19, in this embodiment, depicting the electrical connection between the connector 19 and storage unit 14. Normally, in order to protect the contact terminals 20, the rib 40 is positioned above the contact terminals 20. Therefore, in order to prevent the rib 40 from coming into contact with the ink container 7, the portion of the side wall of the ink container 7 facing the rib 40 needs to be provided with a recess. FIG. 16(*a*) is a side view of the ink container in the third embodiment of the present invention, the storage unit attachment recess of which is similar to the one in the first embodiment, and is expanded upward to accommodate the rib 40. FIG. 16(*b*) is a side view of the ink container in the fourth embodiment of the present invention, the storage unit attachment recess of which is similar to the one in the second embodiment, and is expanded upward to accommodate the rib 40. In these embodiments of the present invention, the connective pads 15 are located on the portion of the substrate 17 close to the top edge of the substrate 17. Therefore, it is possible to expand the recess 23 in order to accommodate the rib 40. Therefore, it is possible to improve the connector 19 in reliability.

(Miscellanies)

An ink container may be integrated with an ink jet cartridge which integrally comprises a recording head. In such a case, an ink jet cartridge integrally comprising an ink container and a recording head is to be mounted into the carriage of a recording apparatus.

The storage element 16 may be mounted on the front surface of the substrate 17 as are the connective pads 15. In such a case, in order to prevent the storage element 16 from coming into contact with the contact terminals 20, the storage element 16 is to be mounted outside the reach of the contact terminals 20, and the connective pads 15 are to be placed on the substrate 17 in such a manner that as the ink container 7 is mounted into the holder 1, the connective pads 15 will be placed above the storage element 16 in terms of the vertical direction of the recording apparatus.

While the invention has been described with reference to the structures disclosed herein, it is not confined to the details set forth, and this application is intended to cover such modifications or changes as may come within the purposes of the improvements or the scope of the following claims.

This application claims priority from

Japanese Patent Application No. 271426/2003 filed Jul. 7, 2003, which is hereby incorporated by reference.

What is claimed is:

1. An ink container for supplying through an ink supply port ink accommodated in a main body of said container, said ink container including a substrate mounted on a surface of the main body of said container, a contact portion, and a storing element electrically connected with said contact said portion, said contact portion and said storing element being provided on said substrate, the improvement residing in that:

said contact portion is disposed at a position more remote from said ink supply port than said storing element, wherein said contact portion is disposed on an outer surface of said substrate, and said storing element is disposed on an inner surface of said substrate, wherein a surface of said main body of said container is provided with a recess engaged with said storing element, and wherein said surface of said main body of said container is provided with a cap mounting recess to which a cap is mountable to seal said ink supply port, and wherein said cap mounting recess is continuous with said recess engaged with said storing element.

2. An ink container according to claim 1, wherein the position of said contact portion and the position of said storing element are at least partly overlapped with each other as seen in a direction perpendicular to the outer surface.

3. An ink container according to claim 1, wherein the position of said contact portion is deviated from a center of the outer surface away from said ink supply port, and wherein the position of said storing element is deviated from a center of the inner surface toward said ink supply port.

4. An ink container according to claim 1, wherein the main body of said container is mountable to a recording device through a holder having a recording head capable of ejecting the ink.

5. An ink container according to claim 4, wherein said main body of said container is mountable to said holder with rotation.

6. An ink container according to claim 1, wherein the main body of said ink container contains the ink.

* * * * *

UNITED STATES PATENT AND TRADEMARK OFFICE

CERTIFICATE OF CORRECTION

PATENT NO. : 7,125,109 B2 
APPLICATION NO. : 10/884951
DATED : October 24, 2006
INVENTOR(S) : Watanabe et al.

It is certified that error appears in the above-identified patent and that said Letters Patent is hereby corrected as shown below:

On Title Page, Item (*)

[*] Notice: Subject to any disclaimer, the term of this patent is extended or adjusted under 35 USC 154(b) by (262) days Delete the phrase "by 262" and insert -- by 221 days--

COLUMN 3
Line 38, "pad 10B" should read --pad 102B--.

COLUMN 6
Line 49, "al" should read --an--.

COLUMN 10
Line 12, "substrate 17" should read --substrate 17.--; and
Line 62, "insert" should read --inserted--.

COLUMN 12
Line 20, "said portion," should read --portion,--.

Signed and Sealed this

Eighth Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,125,109 B2
APPLICATION NO. : 10/884951
DATED : October 24, 2006
INVENTOR(S) : Watanabe et al.

It is certified that error appears in the above-identified patent and that said Letters Patent is hereby corrected as shown below:

On The Title Page, Item (*)

[*] Notice: Subject to any disclaimer, the term of this patent is extended or adjusted under 35 USC 154(b) by (262) days Delete the phrase "by 262" and insert -- by 221 days--

Signed and Sealed this

Twenty-ninth Day of May, 2007

JON W. DUDAS
*Director of the United States Patent and Trademark Office*